US006135357A

United States Patent [19]

Herrin et al.

[11] Patent Number: 6,135,357

[45] Date of Patent: Oct. 24, 2000

[54] APPARATUS FOR ATOMIZING HIGH-VISCOSITY FLUIDS

[75] Inventors: Jeff Lee Herrin, Ankeny, Iowa; Michael Joseph Molezzi, Cincinnati; John Lawrence Dressler, Dayton, both of Ohio

[73] Assignee: General Electric Company, Schenectady, N.Y.

[21] Appl. No.: 09/197,876

[22] Filed: Nov. 23, 1998

[51] Int. Cl.[7] ..... B05B 1/08

[52] U.S. Cl. ..... 239/4; 239/101; 239/102.2

[58] Field of Search ..... 239/4, 101, 102.1, 239/102.2, 71

[56] References Cited

U.S. PATENT DOCUMENTS

| | | | |
|---|---|---|---|
| 3,679,132 | 7/1972 | Vehe et al. | 239/102.2 |
| 3,868,698 | 2/1975 | Dressler | 346/75 |
| 3,900,162 | 8/1975 | Titus et al. | 239/102.2 |
| 4,327,695 | 5/1982 | Schechter | 239/88 |
| 4,702,418 | 10/1987 | Carter et al. | 239/102.2 |
| 4,930,701 | 6/1990 | Porter et al. | 239/102.2 |
| 5,248,087 | 9/1993 | Dressler | 239/102.2 |
| 5,609,919 | 3/1997 | Yuan et al. . | |

FOREIGN PATENT DOCUMENTS

| | | |
|---|---|---|
| 0033717 | 1/1981 | European Pat. Off. . |
| 0235603 | 2/1987 | European Pat. Off. . |
| 0590165 | 9/1992 | European Pat. Off. . |

*Primary Examiner*—Kevin Weldon
*Attorney, Agent, or Firm*—Patrick K. Patnode; Marvin Snyder

[57] ABSTRACT

Apparatus which is selectively operable at low frequencies (less than 5,000 Hz and preferably between about 100 Hz to about 1,000 Hz) breaks up jets of high-viscosity fluid into monodisperse droplets. The apparatus includes a housing having a chamber, a piston disposed in the chamber, a magnetic-coil system operably attached to the housing and to the piston, and an oscillator for driving the magnetic-coil system. The housing and the piston define a reservoir for receiving a supply of high-viscosity fluid which is acted upon by oscillating motion of the piston to impart pressure perturbations on the supply of fluid so that the fluid upon discharge from the reservoir separates and breaks up into a plurality of monodisperse droplets. Also disclosed is a method for optimizing the performance of the apparatus to minimize the power required for droplet formation.

10 Claims, 4 Drawing Sheets

INITIAL PRESSURE PERTURBATION REQUIRED TO MAINTAIN 480mm BREAKUP LENGTH

ELECTRICAL POWER INPUT TO ATOMIZER REQUIRED TO MAINTAIN 480mm BREAKUP LENGTH

APPARATUS FOR ATOMIZING HIGH-VISCOSITY FLUIDS

BACKGROUND OF THE INVENTION

This invention relates to atomizers, and more specifically, to atomizers for atomizing high-viscosity fluids into monodisperse droplets.

Atomization of high-viscosity fluids, fluids having a viscosity much greater than the viscosity of water ($\mu_{water}$=1.0 cP), is a fundamental process step in many industrial processes including, for example, food processing, metal powder production, and polymer production. For example, in the plastics industry, polymer solutions are atomized to enhance the evaporation of a solvent during a precipitation phase of plastic powder production. As the amount of polymer increases in proportion to the amount of solvent, the polymer solution becomes more viscous. As the viscosity of a fluid increases, viscous forces that resist droplet formation increase, correspondingly increasing the energy required to atomize the fluid.

Typical industrial practice is to use high-shear, air-blast atomizers that utilize kinetic energy of a carrier fluid, for example, air accelerated to high speed for atomization. Such atomizers require large volumes of high-pressure carrier gas and inherently generate polydisperse droplet size distributions that are generally less desirable than monodisperse droplet size distributions. Control of this type of atomization process is also difficult since droplet formation is dependent on the local conditions of the streams of carrier gas and fluid to be atomized, for example, turbulence levels, momentum fluxes, and mixing rates.

Liquid droplet generators have been used to atomize fluids having a low-viscosity fluids having a viscosity generally equal to that of water ($\mu_{water}$=1.0 cP). Liquid droplet generators operate by passing a fluid through an orifice and providing a disturbance to the fluid at a certain frequency so that a stream of fluid discharged from the orifice will tend to separate into droplets. For example, liquid droplet generators have been employed in ink jet printer applications for atomizing a fluid jet into a stream of droplets having a diameter less than 1 mm. Such liquid droplet generators have a transducer driven at high frequencies to disturb the fluids, for example, at frequencies of about 50,000 Hertz (Hz).

U.S. Pat. No. 5,248,087 to Dressier (one of the inventors of the present application) discloses a liquid droplet generator for agricultural spraying, spray drying, and fuel injection. This liquid droplet generator device incorporates one or more pairs of piezoelectric transducers and a piston to apply high frequency perturbations on a fluid to atomize the fluid into droplets. In particular, the droplet generator is driven at frequencies of about 5,550 Hz, about 9,640 Hz, and about 9,780 Hz.

The above-noted liquid droplet generators, although suitable for there intended purpose in atomizing low-viscosity fluids with high frequency perturbations, are not suitable for atomizing high-viscosity fluids that require low frequency perturbations. In addition, in the above-noted liquid droplet generators, fluid is contained in a fixed size chamber or reservoir and the transducers are operable only at select natural frequencies of the transducer system, for example, at 7,000 Hz, 13,000 Hz, and 17,000 Hz, and within a range thereof of about 100 Hz. Such configurations limit the ability to optimize the performance of the liquid droplet generator.

Therefore, there is a need for an apparatus selectively operable at low frequencies for breaking up jets of high-viscosity fluid into monodisperse droplets. In addition, there is a need for an apparatus and method in which the performance of the apparatus can be optimized to minimize the power required for droplet formation.

SUMMARY OF THE INVENTION

An apparatus for breaking up one or more jets of high-viscosity fluid into a plurality of monodisperse droplets includes a housing having a chamber, a piston disposed in the chamber to define a reservoir, at least one inlet for receiving fluid into the reservoir, and at least one outlet for discharging fluid from the reservoir. A magnetic-coil system is connected to the housing and to the piston. An oscillator drives the magnetic-coil system for selectively applying pressure perturbations having a frequency of less than about 5,000 Hertz, and particularly less than about 1,000 Hz, to the fluid in the reservoir so that high-viscosity fluid discharged from the reservoir breaks up into a plurality of monodisperse droplets.

The apparatus may further include a pressure transducer for generating a signal in response to pressure perturbations on the fluid in the reservoir, and a controller for controlling the oscillator in response to the signal from the pressure transducer to maintain a generally constant filament length for break up of the jet of high-viscosity fluid into a plurality of monodisperse droplets. The apparatus may also include an optical position sensor for generating a signal in response to the position of the piston, and a controller for controlling a bladder to selectively vary the size of the reservoir.

DETAILED DESCRIPTION OF THE INVENTION

Figure 1:
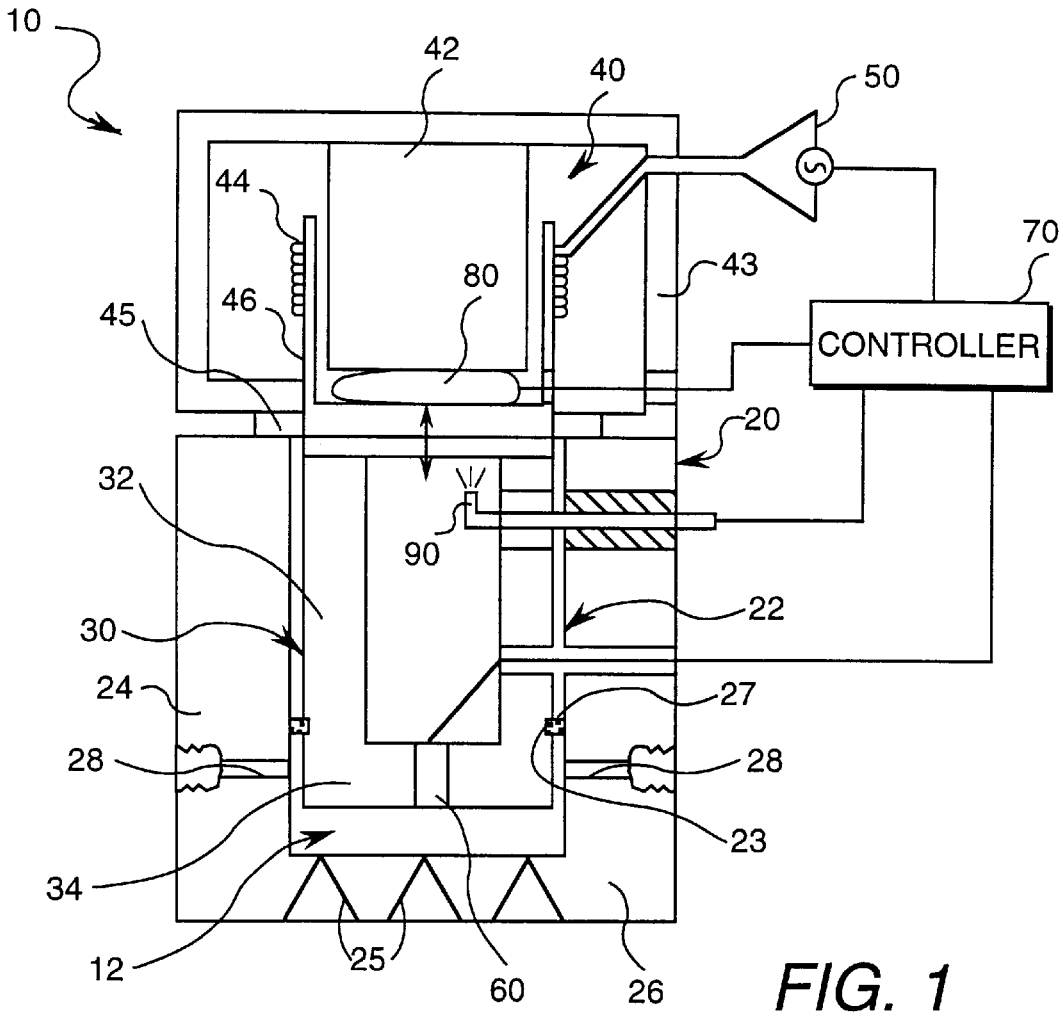
FIG. 1 is a sectional view of an apparatus of the present invention for atomizing high-viscosity fluids.
Figure 3:
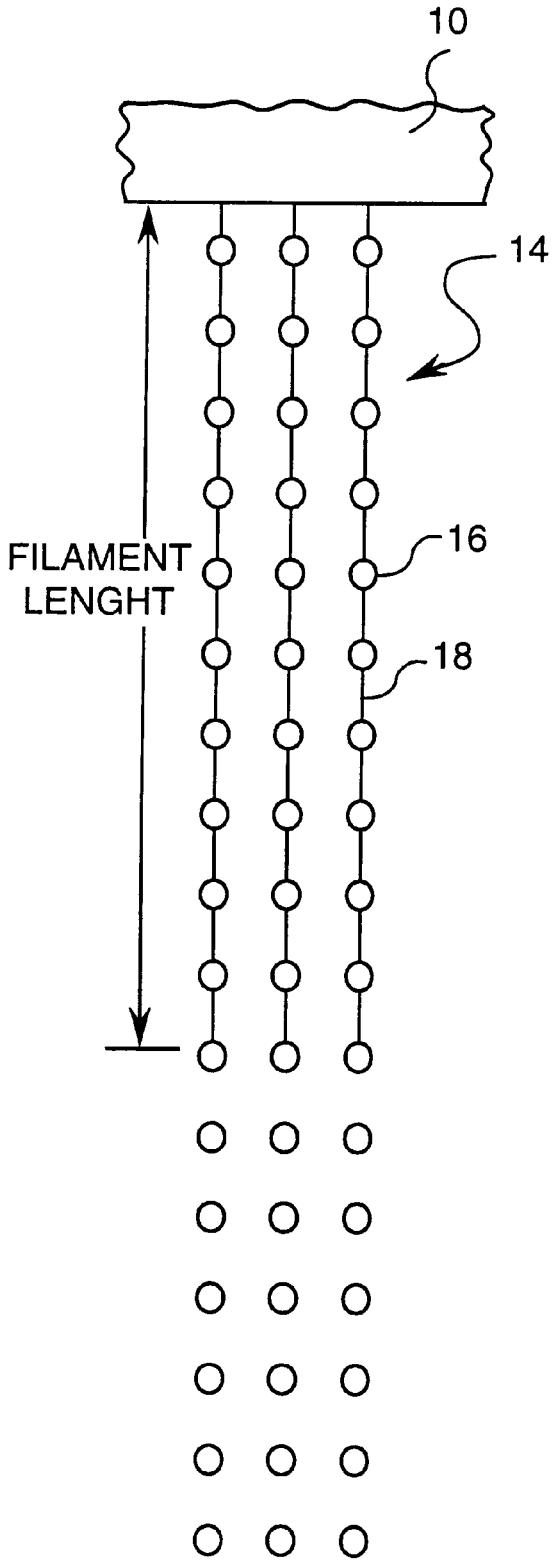
FIG. 3 is a side elevational view of droplets formed by the apparatus shown in FIG. 1.

FIG. 1 illustrates an apparatus 10 for breaking up one or more jets of a high-viscosity fluid, fluids having a viscosity greater than the viscosity of water and typically greater than about 15 cP, into a plurality of monodisperse droplets. Apparatus 10 generally includes a housing 20 having a chamber 22, a piston 30 disposed in chamber 22, a magnetic-coil system 40 attached to housing 20 and piston 30, and an oscillator 50 for driving magnetic-coil system 40. Housing 20 and piston 30 define a reservoir 12 for receiving a supply of fluid. The supply of fluid in reservoir 12 is acted upon by an oscillating motion of piston 30 to impart pressure perturbations on the fluid in reservoir 12 so that the fluid upon discharge from reservoir 12 separates and breaks up into a plurality of monodisperse droplets (as shown in FIG. 3).

Figure 2:
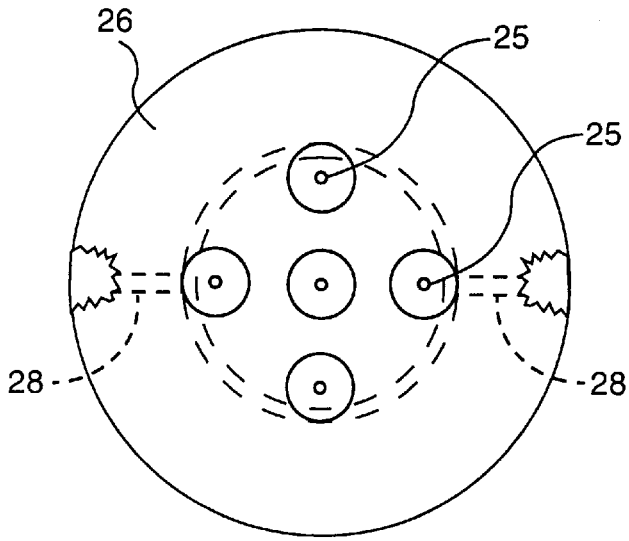
FIG. 2 is an end view of the apparatus of FIG. 1 illustrating an orifice plate.

In an exemplary embodiment, housing 20 includes a vertically extending cylindrical sidewall 24 and a lower horizontally disposed end portion or orifice plate 26 that defines chamber 22 therein. Sidewall 24 includes a pair of inlets 28 that extend through sidewall 24 and open into chamber 22 for introduction of fluid into chamber 22. End portion 26 of housing 20 includes a plurality of outlets or orifices 25, typically five, (as best shown in FIG. 2) for discharging fluid from reservoir 12.

Piston 30 comprises a vertically extending sidewall 32 and a lower end portion or piston head 34. Vertical sidewall 32 is slidably receivable in chamber 22 of housing 20. Desirably, vertically extending sidewall 32 may be provided with a circumferentially extending groove 23 in which is receivable an O-ring 27 for sealing piston 30 to chamber 22 so as to define reservoir 12.

Magnetic-coil system 40 includes a permanent magnet 42 and a coil 44 connected to housing 20 and piston 30, respectively. For example, coil 42 may be supported around a mounting unit 46, which mounting unit 46 is attached to upper end portion of piston 30. Permanent magnet 42 may be supported between coil 44 by magnetic mounting unit 48, which mounting unit 48 is attached to upper portion of housing 20. In an exemplary embodiment, permanent magnet 42 is rigidly linked to orifice plate 26 through mounting unit 48 so that the relative motion therebetween is reduced to maximize the coupling of energy from piston 30 to the fluid. A flexible diaphragm 45 may be disposed between mounting unit 46 and mounting unit 48 to seal magnet 42 and coil 44 from chamber 22.

An oscillator 50, for example, an amplified wave generator, provides a time-varying electrical signal of prescribed amplitude and frequency. As described in greater detail below, oscillator 50 and magnetic-coil system 40 combine to drive piston 30 along a longitudinal axis for applying pressure perturbations on fluid in reservoir 12.

In one embodiment, magnet-coil system 40 and oscillator are selectively operable from 10,000 Hz down to DC (e.g., 0 Hz). Magnetic-coil system 40 and oscillator 50 typically apply pressure perturbations to the fluid in reservoir 12 having a frequency chosen between about 0 Hz to about 5,000 Hz, and preferably less than about 1,000 Hz, and most preferably between about 100 Hz and 500 Hz.

In operation of apparatus 10, high-viscosity fluid to be atomized is directed to the space between housing 20 and piston 30 through inlets 28. The fluid then travels between piston head 34 and orifice plate 24. The high-viscosity fluid is desirably supplied to reservoir 12 at a pressure between about 20 psi to about 60 psi.

Oscillator 50 is activated to produce a current flowing through coil 44, which current interacts with the magnetic field of the permanent magnet 42. This current-magnet interaction produces a force that drives coil 44 and piston 30 along a longitudinal axis of is housing 20. Desirably, oscillator 50 provides an electrical drive signal, for example, a periodic wave based on a single or multiple frequency.

As piston 30 moves toward orifice plate 26, the fluid in the region between piston head 34 and orifice plate 26 is compressed thus causing an acceleration of fluid out of orifices 25. As piston 30 retracts away from orifice plate 26, a deceleration of the fluid leaving through orifices 25 occurs. This continuous accelerating-decelerating fluid motion causes the fluid streams leaving orifices 25 to break up into generally uniform-size drops at the frequency of the current applied to coil 44.

As shown in FIG. 3, streams of fluid 14 discharged from apparatus 10 initially comprise a plurality of droplets 16 attached to each other by a filament 18. The length required for a stream to completely break up into separate drops is known in the art as the "filament length." Aqueous solutions of carboxymethyl cellulose (CMC) with viscosities up to 2000 cP have been atomized into monodisperse droplets in which the frequency of the sinusoidal excitation was varied over the range 100–3000 Hz which produced droplet diameters from about 1.0 mm to about 5.0 mm.

Referring again to FIG. 1, in another aspect of the present invention, apparatus 10 may include a fast-response dynamic pressure transducer 60 mounted in piston head 34 to monitor the performance of apparatus 10 and, in particular, to control the filament length of the jet breakup. Control of the filament length is especially important for spray drying and other applications, for example, where the solvent in the jet or droplet stream volatilizes and, therefore, can potentially freeze the fluid jet prior to breakup.

Figure 4:
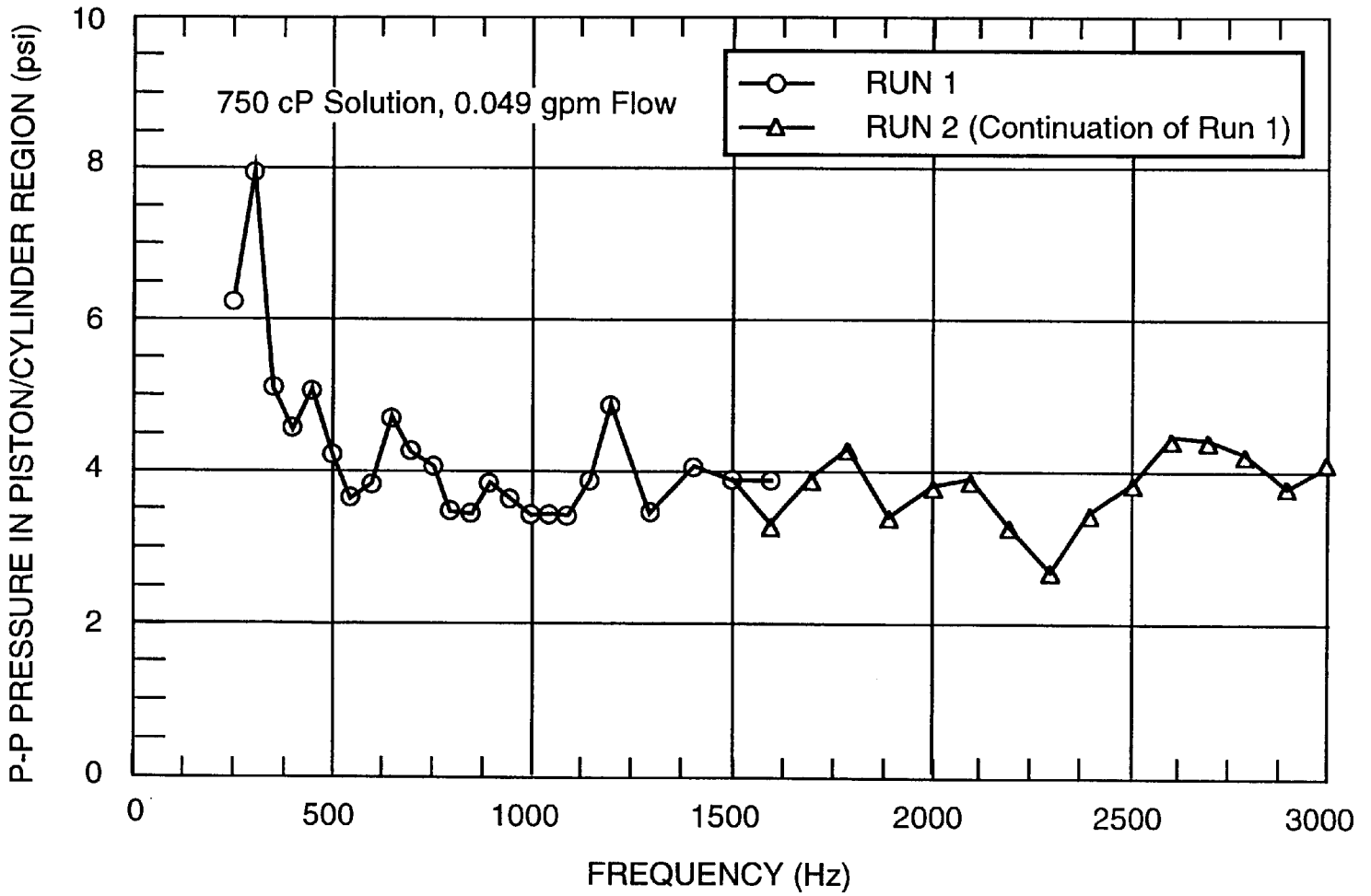
FIG. 4 is a graph of the peak-to-peak reservoir pressure required to maintain a fixed filament length over a range of frequencies.

FIG. 4 illustrates a plot of the peak-to-peak reservoir pressure required for a fixed filament length (480 mm) over a range of frequencies (200 Hz to 3,000 Hz) for a fluid having a fixed viscosity (750 cP). The filament length is substantially insensitive to frequency over this range and is essentially a function of the pressure perturbation. Thus, the filament length can be correlated to the magnitude of the pressure pulse in the reservoir at one frequency and, thus, pressure transducer 60 can act as a "filament length regulator" over a range of frequencies.

With reference again to FIG. 1, pressure transducer 60 may be coupled to a controller 70 that, in turn, is coupled to oscillator 50, for providing a closed-loop control circuit for the atomization process. For example, controller 70 may include a suitable electronic circuit or microprocessor for controlling the power (voltage and current) of the signal to magnetic-coil system 40 to maintain a constant peak-to-peak reservoir pressure during the atomization process, thereby maintaining a fixed filament length. In addition, by monitoring the pressure perturbation in the head of the atomizer, the performance of the atomization system can be consistently monitored and adjusted to give a temporally-stable droplet pattern. This can be especially advantageous in systems where the spray distribution is critical (e.g., in gas turbine combustors).

The present invention also provides a method to minimize the electrical power input required for droplet breakup. For example, resonances exist in the reservoir as the fluid between piston head 34 and orifice plate 26 is continually subjected to a time-varying pressure field because of the piston motion. The resonances determine the efficiency with which the pressure perturbations are coupled into fluid accelerations and decelerations through orifices 25. The resonances are found by operating the atomizer successively over a range of frequencies while maintaining a prescribed pressure perturbation (which as described above also results in a constant filament length) as measured by pressure transducer 60 mounted in head 34 of piston 32. At each frequency, the time-varying voltage and current to the atomizer are measured and the power input calculated.

Figure 5:
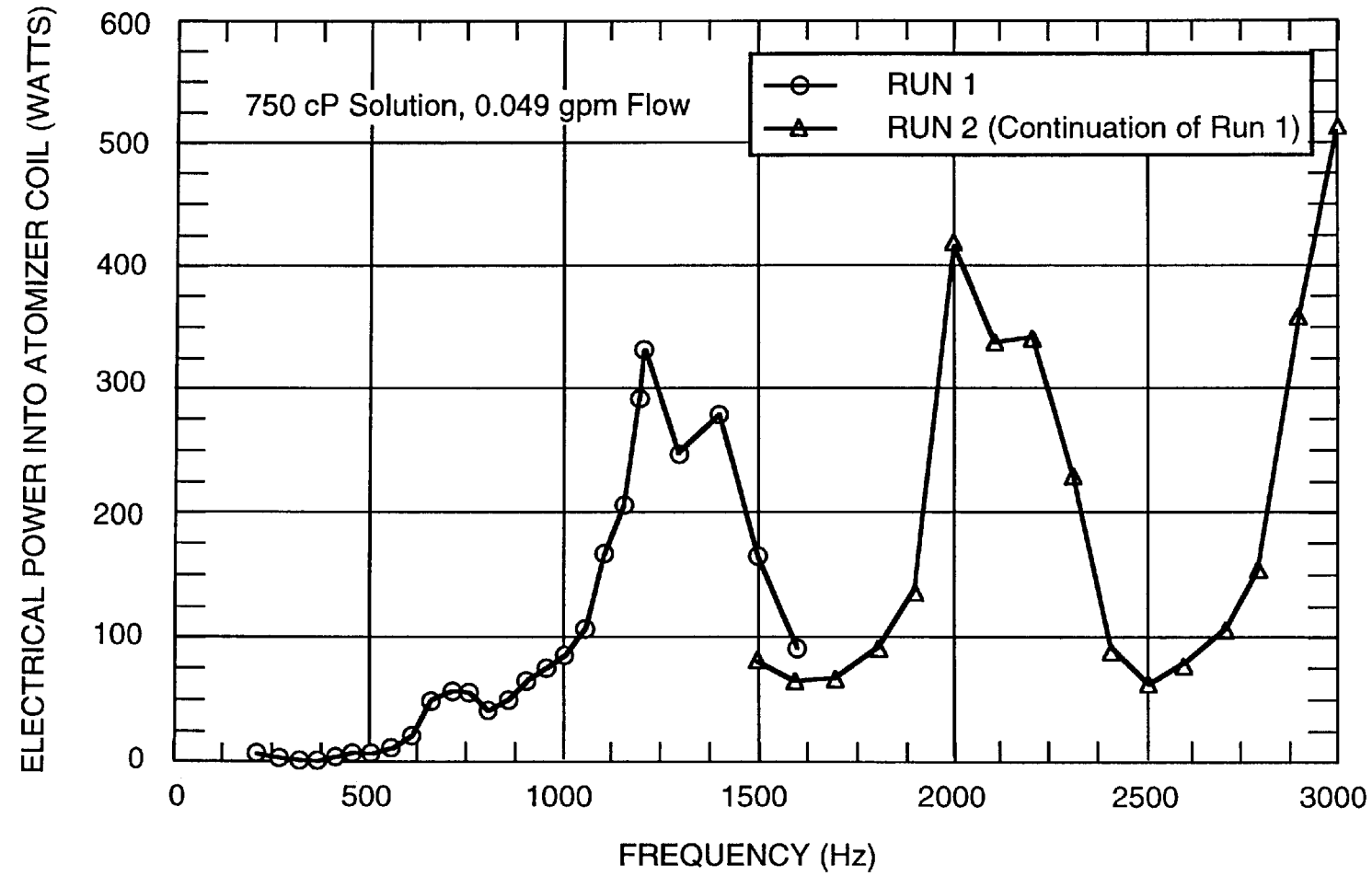
FIG. 5 is a graph of the electrical power required to maintain a fixed filament length for break up of a jet of fluid over a range of frequencies.

FIG. 5 illustrates a plot of the electrical power required to maintain a fixed filament length, (e.g., 480 mm) over a range of frequencies between about 0 Hz to about 3,000 Hz. The locations of the minima in the curve define the most efficient operating frequencies for the device (i.e., the minimum power input required for a given filament length). In this test, points of minimum power consumption occurred at frequencies of about 350 Hz, 800 Hz, 1,600 Hz, and 2,500 Hz.

In another aspect of the present invention, the size of reservoir 12 may be varied. For example, reducing the gap size (between piston head 34 and orifice plate 26) for a given flow rate, the power required is reduced and the curve shown in FIG. 5 is shifted down. Increasing the gap size, for a given flow rate, the power required is increased and the curve shown in FIG. 5 is shifted up.

With reference again to FIG. 1, an air or liquid filled bladder 80 and an optical position sensor 90 may be provided for varying the size of reservoir 12. Desirably, optical position sensor 90 is used to accurately regulate bladder 80 to optimize the gap between piston head 34 and orifice plate 26 or the DC position or nominal position of piston 30 about which piston 30 moves or oscillates.

In this exemplary embodiment, bladder 80 is disposed between magnet 42 and mounting unit 46. Introducing air or liquid into bladder 80 causes mounting unit 46 to move away from magnet 42, and piston head 34 to move closer to orifice plate 26 to reduce the size of reservoir 12. Removing air from bladder 80 causes mounting unit 46 to move closer to magnet 42, and piston head 34 to move away from orifice plate 26 to increase the size of reservoir 12. Optical position sensor 90, for example, a fiber optic sensor, may be fixedly secured to housing 20 and extend through sidewall 32 of piston 30 for indirectly measuring the size of reservoir 12, or the gap between piston head 34 and orifice plate 26.

In this exemplary embodiment, the size of bladder 80 may be controlled by controller 70 via a pump or blower (not shown) and an input signal from optical position sensor 90. Desirably, the size of the gap can be coupled with a signal from pressure transducer 60 to optimize the performance of the apparatus.

From the present description, it will be appreciated by those skilled in the art that other drive mechanisms for applying pressure perturbations on the fluid in the reservoir may be suitable, e.g., actuators, solenoid-type devices, and motor-driven cam- or crank-operated mechanisms, for oscillating the piston. Unlike the prior art include piezoelectric transducers, the instant drive mechanism is not dependent on the inertia of the moving piston to promote atomization, but instead may be dependent on the force generated by the drive mechanism. It will also be appreciated that other mechanisms for varying the size of the reservoir may be suitable, for example, variable spring mechanisms or motor-controlled screw mechanisms. It will be further appreciated that pressure transducer 60 need not be mounted in piston head 34, but instead can be mounted in the housing so long as it is operable to measure pressure perturbations in the reservoir.

In addition, the present invention can be coupled with existing atomization systems to enhance the spatial uniformity of the spray. For example, by coupling the present invention to an existing atomization system, the additional energy input for the atomization process will tend to reduce the occurrences of voids in the spray pattern.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. An apparatus for breaking up one or more jets of a high-viscosity fluid into a plurality of monodisperse droplets, said apparatus comprising:

a housing having a chamber, at least one inlet for receiving fluid into said chamber, and at least one outlet for discharging fluid from said chamber;

means for applying pressure perturbations having a frequency of less than about 5,000 Hertz to a fluid introduced within said chamber so that fluid discharged from said chamber breaks up into a plurality of monodisperse droplets a pressure transducer for generating a signal in response to pressure perturbations on the fluid in said chamber; and a controller for controlling said oscillator in response to said signal from said pressure transducer to maintain a generally constant filament length.

2. The apparatus of claim 1, wherein said means for applying pressure perturbations is selectively operable at a frequency of less than about 1,000 Hertz.

3. The apparatus of claim 2, wherein said means for applying pressure perturbations is selectively operable between about 100 Hertz to about 500 Hertz.

4. The apparatus of claim 1, wherein said means for applying pressure perturbations comprises a piston, a magnetic-coil system connected to said housing and to said piston, and an oscillator for driving said magnetic-coil system.

5. The apparatus of claim 1, further comprising means for maintaining a generally constant filament length.

6. The apparatus of claim 1, wherein said means for applying pressure perturbations comprises a piston that defines a reservoir from which fluid is discharged from said chamber, and further comprises means for selectively varying the size of said reservoir.

7. The apparatus of claim 6, wherein said means for selectively varying the size of said reservoir comprises an optical position sensor for generating a signal in response to the position of said piston, and a controller for controlling a bladder to selectively vary the size of said reservoir.

8. A method for breaking up one or more jets of high-viscosity fluid into a plurality of monodisperse droplets, said method comprising the steps of:

providing a housing and piston within said housing defining a reservoir;

introducing a supply of fluid into said reservoir;

moving said piston to apply pressure perturbations having a frequency of less than 5,000 Hertz to the fluid in said reservoir;

discharging said supply of fluid from said reservoir through at least one orifice so that said fluid breaks up into a plurality of monodisperse droplets monitoring a magnitude of the pressure perturbations on said fluid in said reservoir; and controlling a filament length for break up of the jet of fluid in response to the magnitude of the pressure perturbations.

9. The method of claim 8, wherein said step of applying pressure perturbations comprises applying pressure perturbation having a frequency less that about 1,000 Hertz.

10. The method of claim 8, further comprising the step of varying the size of said reservoir.

* * * * *